US008091254B2

(12) United States Patent
Wang

(10) Patent No.: US 8,091,254 B2
(45) Date of Patent: Jan. 10, 2012

(54) BIOMECHANICS MEDICAL CORRECTIVE SHOE PAD WITH FAR INFRARED RAY ENERGY FIBERS

(75) Inventor: Edmund Wang, Tainan (TW)

(73) Assignee: Jet Crown International Co., Ltd., Tainan (TW)

( * ) Notice: Subject to any disclaimer, the term of this patent is extended or adjusted under 35 U.S.C. 154(b) by 535 days.

(21) Appl. No.: 12/320,805

(22) Filed: Feb. 5, 2009

(65) Prior Publication Data

US 2010/0192413 A1 Aug. 5, 2010

(51) Int. Cl.

| | |
|---|---|
| ***A43B 7/14*** | (2006.01) |
| ***A43B 7/16*** | (2006.01) |
| ***A43B 13/38*** | (2006.01) |
| ***A43B 19/00*** | (2006.01) |

(52) U.S. Cl. ..... 36/91; 36/44; 36/145

(58) Field of Classification Search ..... 36/91, 43, 36/44, 71, 145, 92

See application file for complete search history.

(56) References Cited

U.S. PATENT DOCUMENTS

| | | | | |
|---|---|---|---|---|
| 1,920,771 | A * | 8/1933 | Thoma | 428/101 |
| 4,099,342 | A * | 7/1978 | Singh | 36/44 |
| 4,716,662 | A * | 1/1988 | Bar | 36/44 |
| 6,460,273 | B2 * | 10/2002 | Witjes | 36/71.5 |
| 6,548,118 | B1 * | 4/2003 | Yu | 427/376.2 |
| 6,855,410 | B2 * | 2/2005 | Buckley | 428/311.11 |
| 7,037,571 | B2 * | 5/2006 | Fish et al. | 428/166 |
| 2010/0192418 | A1 * | 8/2010 | Johnson | 36/127 |

FOREIGN PATENT DOCUMENTS

| | | | |
|---|---|---|---|
| AU | 2006235963 | A1 * | 8/2007 |
| JP | 10120937 | A * | 5/1998 |
| JP | 2008093388 | A * | 4/2008 |

* cited by examiner

*Primary Examiner* — Jila Mohandesi

(74) *Attorney, Agent, or Firm* — Rosenberg, Klein & Lee

(57) ABSTRACT

A biomechanics medical corrective shoe pad with far infrared ray energy fibers includes a bacteriostasis surface cloth layer, an inner foamed layer, a far infrared ray energy emitting fiber layer, a polyethene layer, and a bacteriostasis cloth layer, which are positioned one on another in sequence, and heat-pressed and joined together with a mold; the far infrared ray energy emitting fiber layer includes a fiber, and far infrared ray energy containing mineral granules joined on the fiber; the shoe pad includes a peripheral area, a supporting area, and a cambering area, which undergo different-temperature heat-pressing processes; the supporting area and the cambering area are shaped according to ergonomics and human dynamics and in such a manner as to match pressure-responsive points of a man's sole; therefore, the shoe pad can absorb shock, reduce pressure, provide sufficient protection and support, and massage the wearer's foot.

4 Claims, 5 Drawing Sheets

BIOMECHANICS MEDICAL CORRECTIVE SHOE PAD WITH FAR INFRARED RAY ENERGY FIBERS

BACKGROUND OF THE INVENTION

1. Field of the invention

The present invention relates to a biomechanics medical corrective shoe pad with far infrared ray energy fibers, more particularly one, which includes a bacteriostasis surface cloth layer, an inner foamed layer, a far infrared ray energy emitting fiber layer, a polyethene layer, and a bacteriostasis cloth layer, and which is shaped in such a way as to match pressure-responding points of a man's sole, and can absorb shock and provide sufficient protection and support; the various layers are positioned one on another in sequence, and heat-pressed with a mold; the corrective shoe pad includes a peripheral area, a supporting area, and a cambering area, which undergo different-temperature heat-pressing processes.

2. Brief Description of the Prior Art

Corrective shoe pads can make the wearer more comfortable and absorb sweat. Resin is a common material of insoles; in manufacturing, resin and foaming substance are put in a mold to form a foamed resin product, and next a piece of cloth is stuck on the foamed resin product, and both are cut into an shoe pad. The foamed resin shoe pad is very soft and can absorb shock.

The above-mentioned shoe pad has a drawback: The cloth is prone to partly separate from the foamed body if the shoe pad is subjected to high temperature or the wearer's foot rubs against the pad frequently. The cloth can separate from the foamed body after the pad is washed. Consequently, the cloth can break, and the wearer's sweat can cause calcification of the foamed body.

Another shoe pad is available, which includes a foamed body, a cloth, and a bamboo charcoal layer; the bamboo charcoal layer can emit far infrared rays, deodorize the shoe, advance blood circulation, and activate the cells. However, the bamboo charcoal layer has a relatively short service life in respect of far infrared rays' emission; the bamboo charcoal layer has to be exposed to ultraviolet rays of the sun to recover the far infrared rays emission capability. Therefore, such a shoe pad is inconvenient to use.

Taiwanese patent application no. I289055 has been publicized, which taught a shoe pad and correction shoe capable of adjusting an outwardly turning force of a foot arch. The shoe pad is made of a mixture of PU and many granules capable of emitting far infrared rays, and therefore can emit far infrared rays to advance blood circulation and activate the wearer's cells. However, the connection between the far infrared rays emitting granules and the PU body of the shoe pad isn't very strong. Consequently, the granules can decompose, become fragile and powder, and some parts of the PU body can be easily washed away after the shoe pad has been used a certain length of time. In other words, the shoe pad has a relatively short service life.

Moreover, the above-mentioned shoe pad structure taught in Taiwan patent application no. I289055 includes a supporting portion, and a piece of ornamental cloth, which is stuck on the supporting portion; the ornamental cloth is made of a natural or artificial cloth material having activated charcoal fibers added therein, and therefore can deodorize the shoe and kill bacteria. However, the activated charcoal fibers will be easily saturated with germs and moisture through use. Consequently, the shoe pad has to be exposed to the sun regularly to activate the charcoal fibers again otherwise the charcoal fibers can't serve their purpose. In other words, the shoe pad isn't convenient to use.

Furthermore, the above-mentioned shoe pad structure taught in Taiwan patent application no. I289055 isn't shaped in such a manner as to provide satisfactory support to a foot arch of the wearer. Consequently, the muscle ligament of the wearer's foot arch can be subjected to a sudden pulling force to become sore and painful, and get injured when the wearer is standing or walking.

Taiwanese patent application no. M338561 has been publicized, which taught an elastic pad (b), as shown in FIG. 7. The elastic pad (b) is made of a compound material, and is shaped by means of heat-pressing. The elastic pad (b) includes a thenar portion, a knife portion, and a heel portion, and it can be joined on different-sized insoles. However, the elastic pad can only absorb shock, having single function. Referring to FIG. 7, when the elastic pad (b) bears the wearer's body weight, it will be pressed to become flat, incapable of providing sufficient support to the arch portion and the massage-responsive bubbling-spring point of the wearer's foot. Consequently, the muscle ligament of the wearer's foot arch can be subjected to a sudden pulling force to become sore and painful, and get injured when the wearer is standing.

Moreover, when the wearer is standing or walking, the elastic pad (b) will become flat, and therefore can't provide suitable support to the arch portion and the massage-responsive bubbling-spring point of the wearer's foot. In other words, the elastic pad (b) can't help divide the pressure caused against the foot by the wearer's body weight. Consequently, the wearer's foot arch is prone to get sore and painful when the wearer is walking.

Therefore, it is a main object of the present invention to provide an improvement on a shoe pad to overcome the above problems.

SUMMARY OF THE INVENTION

A biomechanics medical corrective shoe pad includes a bacteriostasis surface cloth layer, an inner foamed layer, a far infrared ray energy emitting fiber layer, a polyethene layer, and a bacteriostasis cloth layer, which are positioned one on another in sequence, and heat-pressed and joined together with a mold; the far infrared ray energy emitting fiber layer includes a fiber, and far infrared ray energy containing mineral granules joined on the fiber; the shoe pad includes a peripheral area, a supporting area, and a cambering area, which undergo different-temperature heat-pressing processes; the supporting area will support an arch, a lateral arch portion, and a heel of a wearer's foot; peripheral areas of the various layers are firmly fixed together so that the periphery of the shoe pad can't open, and the wearer's sweat won't come into contact with the inner foamed layer, thus preventing calcification and breakage of the inner foamed layer. The supporting area and the cambering area are shaped according to ergonomics and human dynamics and in such a manner as to match pressure-responding points of a man's sole; therefore, the shoe pad can absorb shock, reduce pressure, provide sufficient protection and support, and massage the wearer's foot.

BRIEF DESCRIPTION OF THE DRAWINGS

The present invention will be better understood by referring to the accompanying drawings, wherein.

DETAILED DESCRIPTION OF THE PREFERRED EMBODIMENTS

Figures 1, 4:
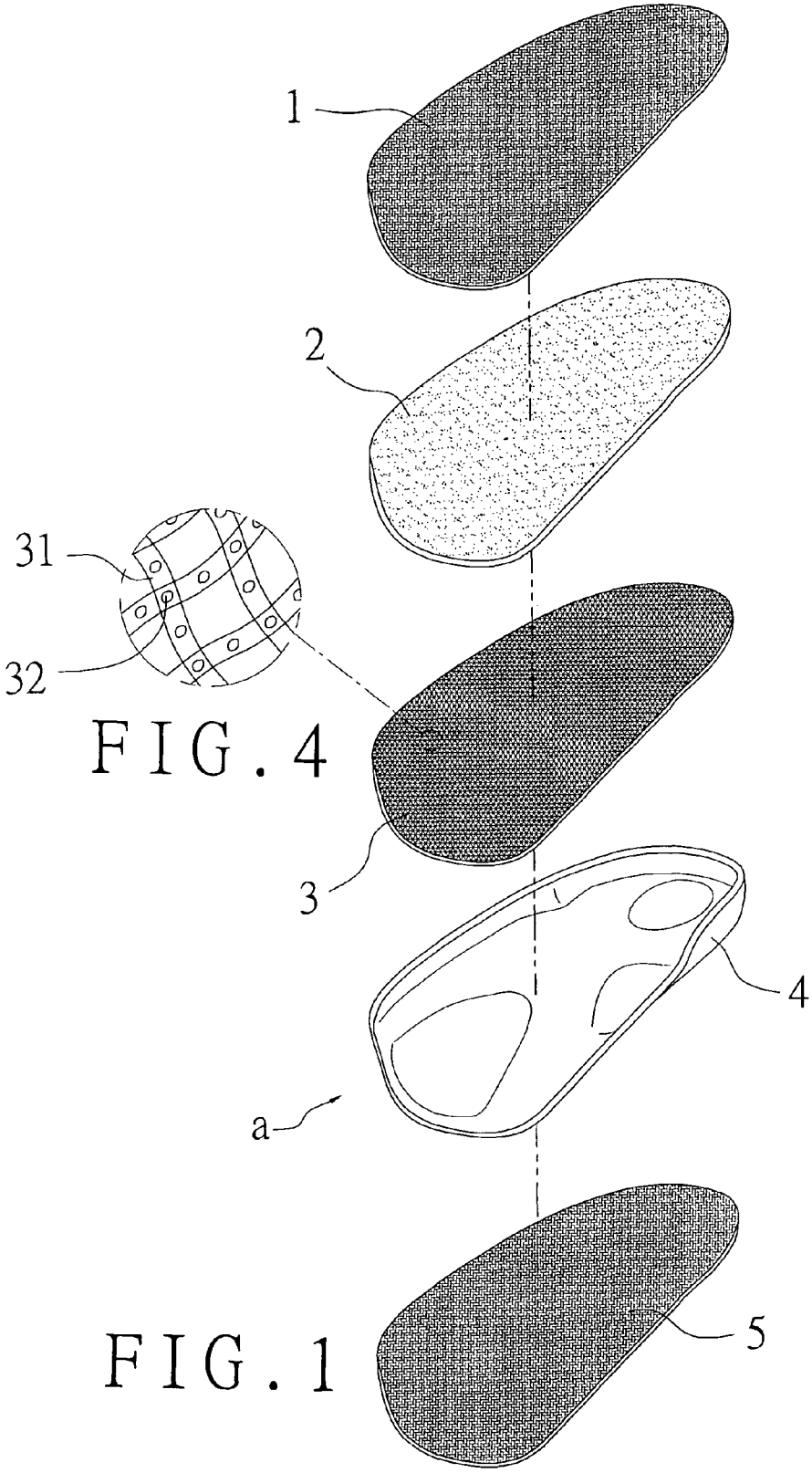
FIG. 1 is an exploded perspective view of the present invention.
FIG. 4 is a partial sectional view of the present invention.
Figure 2:
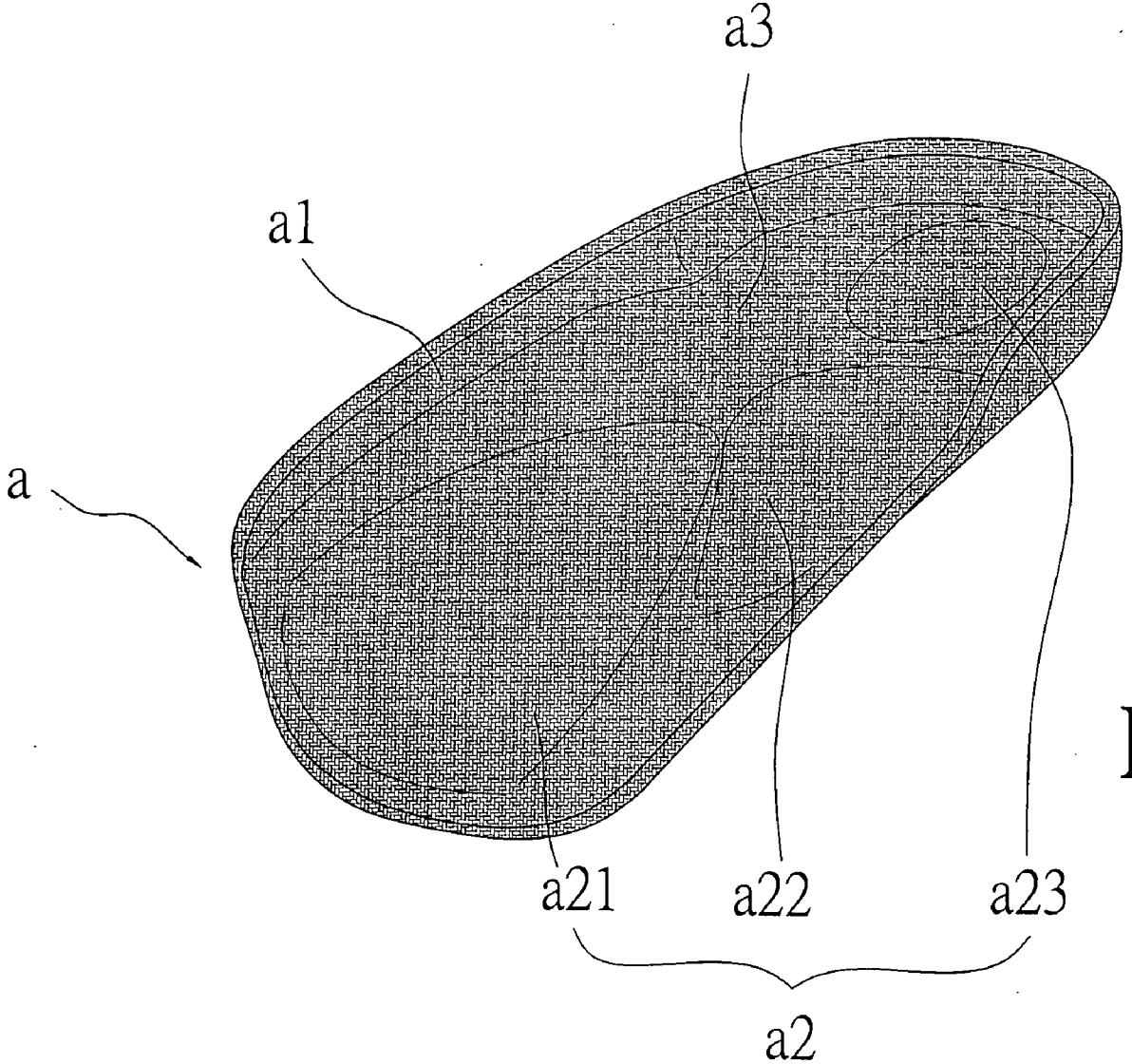
FIG. 2 is a perspective view of the present invention.
Figure 3:
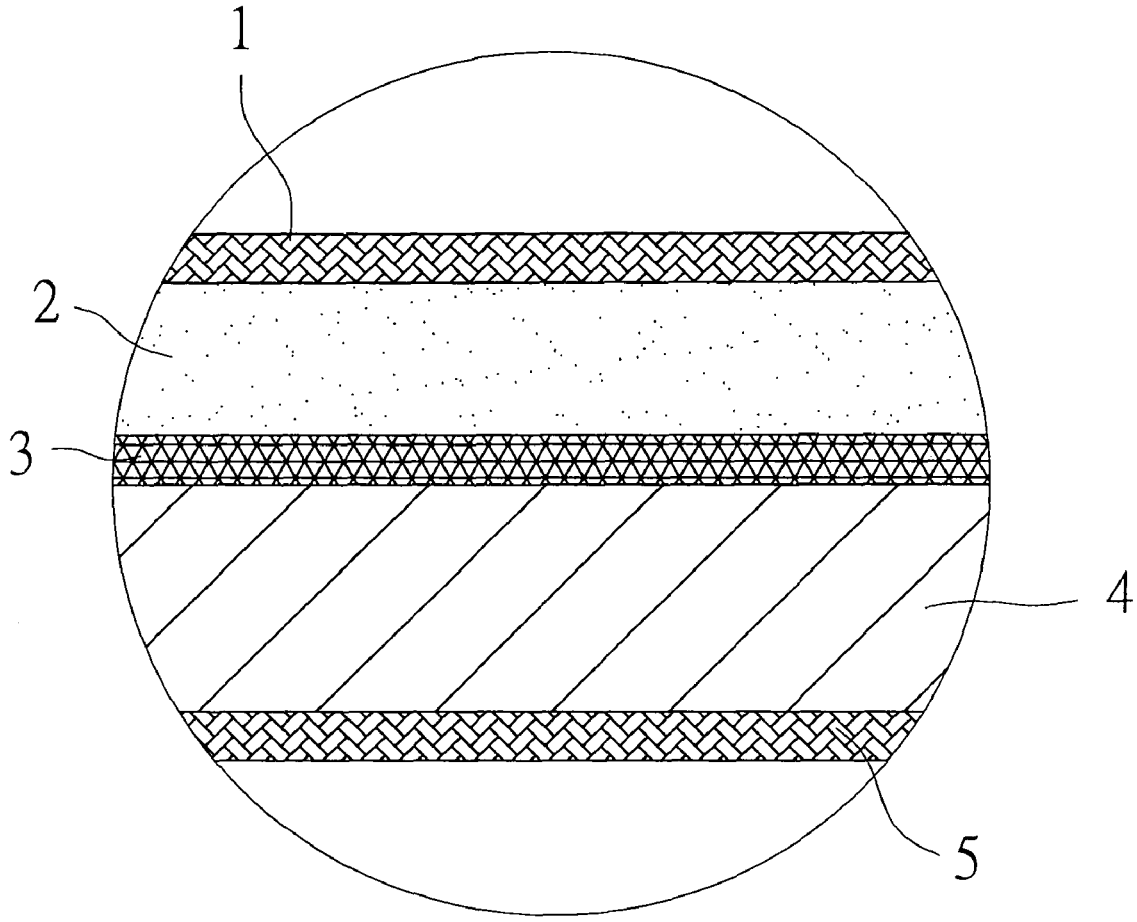
FIG. 3 is a lateral sectional view of the present invention.

Referring to FIG. 1 to FIG. 3, a preferred embodiment (a) of a biomechanics medical corrective shoe pad with far infrared ray energy fibers in the present invention consists of a bacteriostasis surface cloth layer 1, a foamed layer 2, a far infrared light ray emitting fiber layer 3, a polyethene layer 4, and a bacteriostasis cloth layer 5. The far infrared ray energy emitting fiber layer 3 consists of a fiber 31, and far infrared ray energy containing mineral granules 32 joined on the fiber 31.

The biomechanics medical corrective shoe pad of the present invention is made according to the following steps:

(A) superimposing: the bacteriostasis surface cloth layer 1, the foamed layer 2, the far infrared ray energy emitting fiber layer 3, the polyethene layer 4, and the bacteriostasis cloth layer 5 are cut into the shape of the shoe pad (a), and positioned one on another in sequence;

(B) heat-pressing: the bacteriostasis surface cloth layer 1, the foamed layer 2, the far infrared ray energy emitting fiber layer 3, the polyethene layer 4, and the bacteriostasis cloth layer 5 are heat-pressed and joined together by means of a mold; the shoe pad (a) includes a peripheral area (a1), a supporting area (a2), and a middle cambering area (a3), which undergo different-temperature heat-pressing processes;

the peripheral area (a1) undergoes a heat-pressing process at 125° C. to 155° C. such that the peripheral areas (a2) of the various layers 1, 2, 3, 4 and 5 of the shoe pad (a) are firmly joined together;

the supporting area (a2) of the shoe pad (a) undergoes a heat-pressing process at 45° C. to 65° C.; the supporting area (a2) includes a foot arch supporting area (a21), a lateral arch portion supporting area (a22), and a heel supporting area (a23), which support an arch, a lateral arch portion, and a heel of the wearer's foot respectively;

the cambering area (a3) undergoes a heat-pressing process at 85° C. to 95° C. so as to camber the various layers 1, 2, 3, 4 and 5 of the shoe pad (a) except for their peripheral areas (a1) and supporting areas (a2);

(C) finishing: the bacteriostasis surface cloth layer 1, the foamed layer 2, the far infrared ray energy emitting fiber layer 3, the polyethene layer 4, and the bacteriostasis cloth layer 5 are joined to comprise the shoe pad (a) with their peripheral areas being firmly fixed together; thus, the show pad (a) includes a supporting area (a2), and a cambering area (a3) besides the peripheral area (a1).

Figure 5:
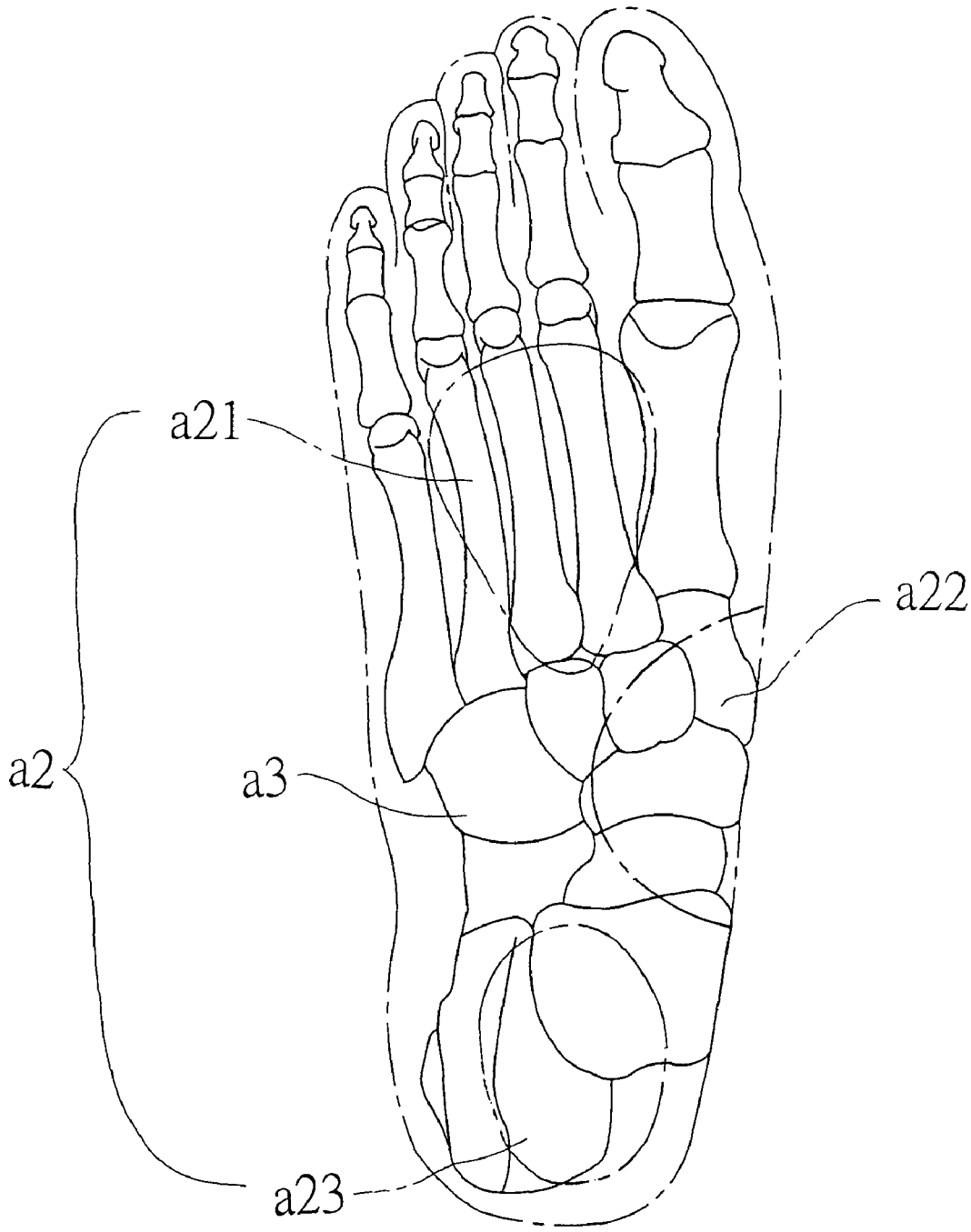
FIG. 5 is a view of the present invention with a man's foot being supported thereon.
Figure 7:
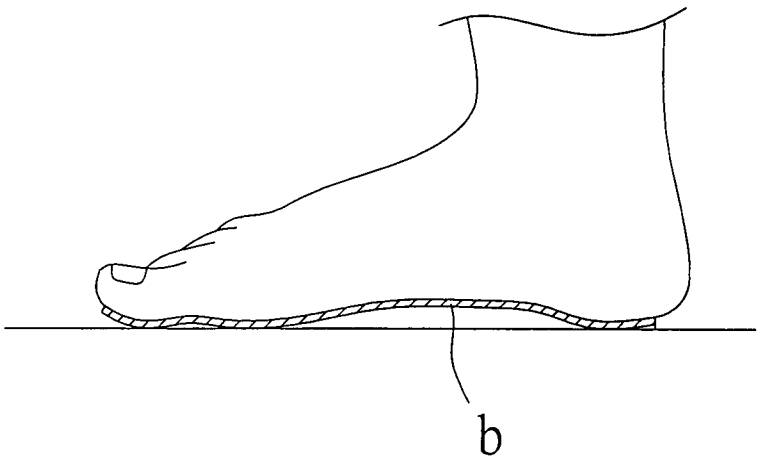
FIG. 7 (PRIOR ART)
FIG. 7 is a side view of the currently existing shoe pad with a man's foot being supported thereon.
Figure 6:
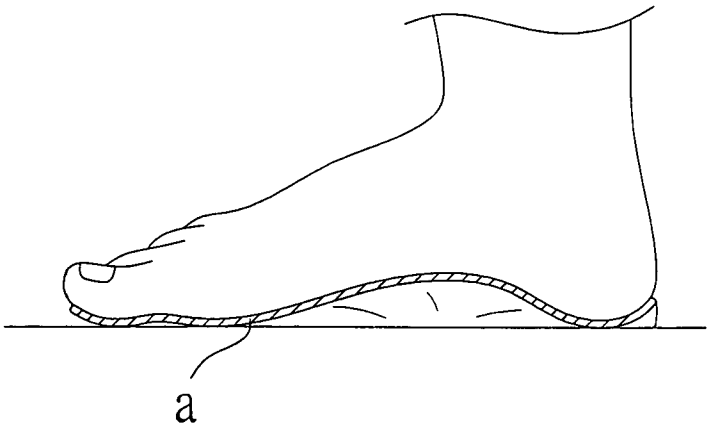
FIG. 6 is a side view of the present invention with a man's foot being supported thereon.

In use, an arch, a lateral arch portion, and a heel of a wearer's foot will contact the foot arch supporting area (a21), the lateral arch portion supporting area (a22), and the heel supporting area (a23) of the shoe pad (a) respectively. And, the cambering area (a3) will support other portions of the wearer's foot, as shown in FIG. 5. Therefore, the shoe pad can massage the pressure-responding points of the wearer's sole effectively.

The supporting area and the cambering area of the shoe pad of the present invention are shaped according to ergonomics and human dynamics and in such a manner as to match pressure-responsive points of a man's sole, and therefore can absorb shock, reduce pressure, provide sufficient protection and support, and massage the wearer's foot.

The soft foamed layer 2 will absorb shock when the wearer is walking. And, the far infrared light ray emitting fiber layer 3 will release far infrared rays; thus, the blood vessels of the wearer's foot will be further expanded, and blood circulation becomes smoother. Moreover, the bacteriostasis cloth layer 5 will deodorize and sterilize the shoe pad and the wearer's foot.

The peripheral area (a1) of the shoe pad (a) has undergone a relatively high temperature heat-pressing process so that the peripheral areas of the various parts, i.e. the bacteriostasis surface cloth layer 1, the foamed layer 2, the far infrared light ray emitting fiber layer 3, the polyethene layer 4, and the bacteriostasis cloth layer 5, are firmly joined together. Therefore, the periphery of the shoe pad can't open; the wearer's sweat won't come into contact with the inner foamed layer 2, thus preventing calcification and breakage of the inner foamed layer 2. Furthermore, the far infrared ray energy emitting fiber layer 3 is properly wrapped in the shoe pad to have relatively long service life. In other words, the far infrared ray emitting function can last long time.

From the above description, it can be seen that the present invention has the following advantages:

1. The peripheral area of the shoe pad has undergone a hot temperature heat-pressing process so that the periphery of the shoe pad can't break or open. Therefore, the wearer's sweat won't come into contact with the inner foamed layer, thus preventing calcification and breakage of the inner foamed layer.

2. The peripheral area of the shoe pad has undergone a hot temperature heat-pressing process so that the periphery of the shoe pad can't break or open. Therefore, the far infrared ray energy emitting fiber layer is wrapped in other parts of the shoe pad to have relatively long service life; the far infrared ray emitting function can last long time.

3. The far infrared ray energy emitting fiber layer can release far infrared rays; thus, the blood vessels of the foot of the shoe wearer will be further expanded, and the wearer's blood circulation becomes smoother.

4. The bacteriostasis cloth layer of the shoe pad can prevent bacteria's further growth.

5. The corrective shoe pad of the present invention is shaped according to standard foot and arch shape, and the supporting area and the cambering area of the pad are shaped according to ergonomics and human dynamics and in such a manner as to match pressure-responsive points of a man's sole, and therefore can absorb shock, reduce pressure, provide sufficient protection and support, and massage the wearer's foot.

6. The far infrared ray energy containing mineral granules are joined on a fiber to comprise the far infrared ray energy emitting fiber layer instead of being directly mixed in the material of the foamed layer to exist on the foamed layer; thus, the far infrared ray energy containing mineral granules have long service life, which could easily decompose, become fragile or powder if they were directly mixed in the material of the foamed layer.

7. The foot arch supporting area, the lateral arch portion supporting area, and the heel supporting area of the shoe pad will contact an arch, a lateral arch portion, and a heel of a wearer's foot respectively. And, the cambering area will support other portions of the wearer's foot. Therefore, the shoe pad of the present invention can massage the pressure-responsive points of the wearer's sole effectively.

What is claimed is:

1. Biomechanics medical corrective shoe pad with far infrared ray energy fibers, comprising a bacteriostasis surface cloth layer, a foamed layer, a far infrared ray energy emitting fiber layer, a polyethene layer, and a bacteriostasis cloth layer; the far infrared ray energy emitting fiber layer including a fiber, and far infrared ray energy containing mineral granules joined on the fiber;

the corrective shoe pad being made according to following steps:

(A) superimposing: the bacteriostasis surface cloth layer, the foamed layer, the far infrared ray energy emitting fiber layer, the polyethene layer, and the bacteriostasis cloth layer are positioned one on another in sequence after having been cut into a shape of the shoe pad, and;

(B) heat-pressing: the bacteriostasis surface cloth layer, the foamed layer, the far infrared ray energy emitting fiber layer, the polyethene layer, and the bacteriostasis cloth layer are heat-pressed to be joined together with a mold; the shoe pad including a peripheral area, a supporting area, and a cambering area; the peripheral area, the supporting area, and the cambering area undergoing different-temperature heat-pressing processes;

the peripheral area undergoing a heat-pressing process at 125° C. to 155° C. such that peripheral areas of said layers are firmly joined together;

the supporting area undergoing a heat-pressing process at 45° C. to 65° C.; the supporting area including a plurality of supporting areas to support different parts of a wearer's sole respectively;

the cambering area undergoing a heat-pressing process at 85° C. to 95° C. so as to camber portions of said layers except for the peripheral areas and the supporting areas; and (C) finishing: the bacteriostasis surface cloth layer, the foamed layer, the far infrared ray energy emitting fiber layer, the polyethene layer, and the bacteriostasis cloth layer are joined to comprise the shoe pad with peripheral areas being firmly fixed together so that the shoe pad includes a supporting area, and a cambering area.

2. Biomechanics medical corrective shoe pad with far infrared ray energy fibers as claimed in claim 1, wherein the supporting area includes a foot arch supporting area to contact a foot arch of a wearer.

3. Biomechanics medical corrective shoe pad with far infrared ray energy fibers as claimed in claim 1, wherein the supporting area includes a lateral arch portion supporting area to contact a lateral arch portion of a wearer.

4. Biomechanics medical corrective shoe pad with far infrared ray energy fibers as claimed in claim 1, wherein the supporting area includes a heel supporting area to contact a heel of a wearer's foot.

* * * * *